United States Patent [19]

Howe, deceased et al.

[11] 4,309,013

[45] Jan. 5, 1982

[54] FREIGHT CARRIER

[76] Inventors: Theodore Howe, deceased, late of St. Annes on Sea, England; by Dorothy E. Howe, executrix, 17, Heyhouses La., St. Annes on Sea, Lancashire, England

[21] Appl. No.: 125,445

[22] Filed: Feb. 28, 1980

Related U.S. Application Data

[63] Continuation of Ser. No. 944,023, Sep. 20, 1978, abandoned, which is a continuation of Ser. No. 852,840, Nov. 18, 1977, abandoned, which is a continuation-in-part of Ser. No. 677,837, Apr. 16, 1976, abandoned.

[51] Int. Cl.[3] ..... B65D 19/12

[52] U.S. Cl. ..... 248/346; 16/297; 108/53.1; 108/55.1; 108/56.1

[58] Field of Search ..... 108/51.1, 53.1, 53.5, 108/55.1–55.5, 56.1, 90, 133; 280/145; 105/381; 16/180, 190

[56] References Cited

U.S. PATENT DOCUMENTS

| | | | |
|---|---|---|---|
| 1,632,269 | 6/1927 | Bradley . | |
| 1,716,394 | 6/1929 | Trammell . | |
| 2,014,591 | 9/1935 | Sanders . | |
| 2,500,057 | 3/1950 | Borderd et al. | 16/180 |
| 2,587,200 | 2/1952 | Nottingham | 217/60 |
| 2,694,235 | 11/1954 | Jansen | 16/180 X |
| 2,909,130 | 10/1959 | Henrikson et al. | 280/145 X |
| 2,956,763 | 10/1960 | D'Arca . | |
| 2,963,248 | 12/1960 | Anderson | 108/55.1 X |
| 3,064,847 | 11/1962 | Ostrom | 217/60 E |
| 3,103,693 | 9/1963 | Tenniswood et al. | 16/190 |
| 3,204,778 | 9/1965 | Nawman . | |
| 3,632,010 | 1/1972 | Marty | 220/6 |
| 3,665,869 | 5/1972 | Howe | 108/53.1 |
| 3,752,332 | 8/1973 | Theurer | 108/56.1 |

FOREIGN PATENT DOCUMENTS

| | | |
|---|---|---|
| 243681 | 11/1965 | Austria . |
| 255964 | 7/1967 | Austria . |
| 373427 | 4/1923 | Fed. Rep. of Germany . |
| 1556049 | 1/1970 | Fed. Rep. of Germany . |
| 2252022 | 5/1974 | Fed. Rep. of Germany . |
| 1078484 | 8/1967 | United Kingdom . |

*Primary Examiner*—William E. Lyddane
*Attorney, Agent, or Firm*—Norris & Bateman

[57] ABSTRACT

A freight carrier comprises a flat rectangular base having a post at each corner pivotally mounted on the base so as to be capable of being selectively pivoted between a folded position, in which the post lies parallel to and adjacent to the base, and an erected upright position, in which the post is perpendicular to the base, each corner post being spring biased in a sense which assists the pivotal movement of post towards the erected upright position.

12 Claims, 5 Drawing Figures

FREIGHT CARRIER

This application is a continuation of Ser. No. 944,023 filed Sept. 20, 1978, now abandoned, which was a continuation of Ser. No. 852,840 filed Nov. 18, 1977, now abandoned, which was a continuation-in-part of Ser. No. 677,837, filed Apr. 16, 1976, now abandoned.

The present invention relates to freight carriers or containers of the type usually known as cargo flats.

A freight carrier of this type is already known, for example, from our U.S. Pat. No: 3,568,608, and the carrier comprises a substantially flat, rectangular base structure having a post member at each corner thereof which is pivotally mounted on the base structure so as to be capable of being selectively moved between a folded position, in which the post lies parallel to and adjacent to the base structure and an erected position in which the post is perpendicular to or substantially perpendicular to the base structure, that is upright in the normal orientation of the carrier. A plurality of cross members are connected between pairs of the corner posts when the latter are in their erected positions to form side and end members of the assembled carrier.

In some embodiments of the foregoing carrier, the two corner posts at each longitudinal end of the carrier are permanently joined together by one or more cross members so that the two corner posts in each end pair thereof are constrained to move together as a unitary structure when the posts are pivoted on the base structure.

In these latter circumstances especially, it has been found to be difficult to erect the carrier due to the fact that the weight of each end structure which comprises a pair of corner posts and the cross member or cross members connecting these corner posts, can amount to several hundred pounds. Since these end structures are normally pivoted by hand between their two positions during erection or folding of the carrier, it can require more than one person to erect or fold the carrier. In addition, a similar problem can arise even when the pairs of end corner posts are not connected, since the individual corner post can be too heavy for one person to pivot relatively to the base structure of the carrier between the erected and folded positions.

The object of the invention is to provide a carrier which can be erected and folded with less manual effort than in the case of the known carriers described above.

According to this invention, a freight carrier comprises a substantially flat rectangular base structure having a post member at each corner thereof which is pivotally mounted on the base structure so as to be capable of being selectively pivoted between a folded position, in which the post member lies substantially parallel to and adjacent to the base structure, and an erected, upright position, in which the post member is perpendicular to or substantially perpendicular to the base structure, and means whereby said corner post member is resiliently biased in a sense which assists the pivotal movement of said post member towards the erected upright position, said resilient biasing means comprising elongated tension spring means extending generally lengthwise of the post member, one end of said spring means being connected to a point on the post member, and the other end of the spring means being connected to a point on the base structure spaced from the pivotal axis of said post member so that when the post member is moved to said folded position spring tension is increased.

Preferably, said spring means is a helical coil spring and the point on the base structure to which said other end of said spring is connected is disposed on the side of the pivotal axis of the post member which is remote from the free end of the post member when the post member is in said folded position.

Preferably, also, said spring means is a helical coil spring and the point on the base structure to which the upper end of said spring is connected is disposed above and to one side of the pivotal axis of the post member. Abutment means is, preferably, provided for preventing said post member from being pivoted past the erected upright position.

Preferably, there are two corner post members at each longitudinal end of the carrier base structure joined together by at least one cross member whereby the two corner post members in each end pair thereof are constrained to move together as a unitary structure when being pivoted on the base structure. Alternatively, the two corner post members associated with each side of the carrier base structure are joined together by at least one cross member whereby the two corner post members at each side are constrained to move together as a unitary structure when being pivoted on the base structure.

Preferably, also, said spring means is an elongated helical coil spring that is disposed substantially within the confines of said post member in both said positions. The post member, preferably, has at its end adjacent to the base structure a part that extends substantially parallel to the path of movement of the post member between said positions and said part is mounted on a fixed pivot on the base structure spaced from the connection of said other end of the tension spring means to said base structure.

A preferred embodiment of the invention will now be described, by way of example only, with reference to the accompanying drawings in which:-

Figure 1:
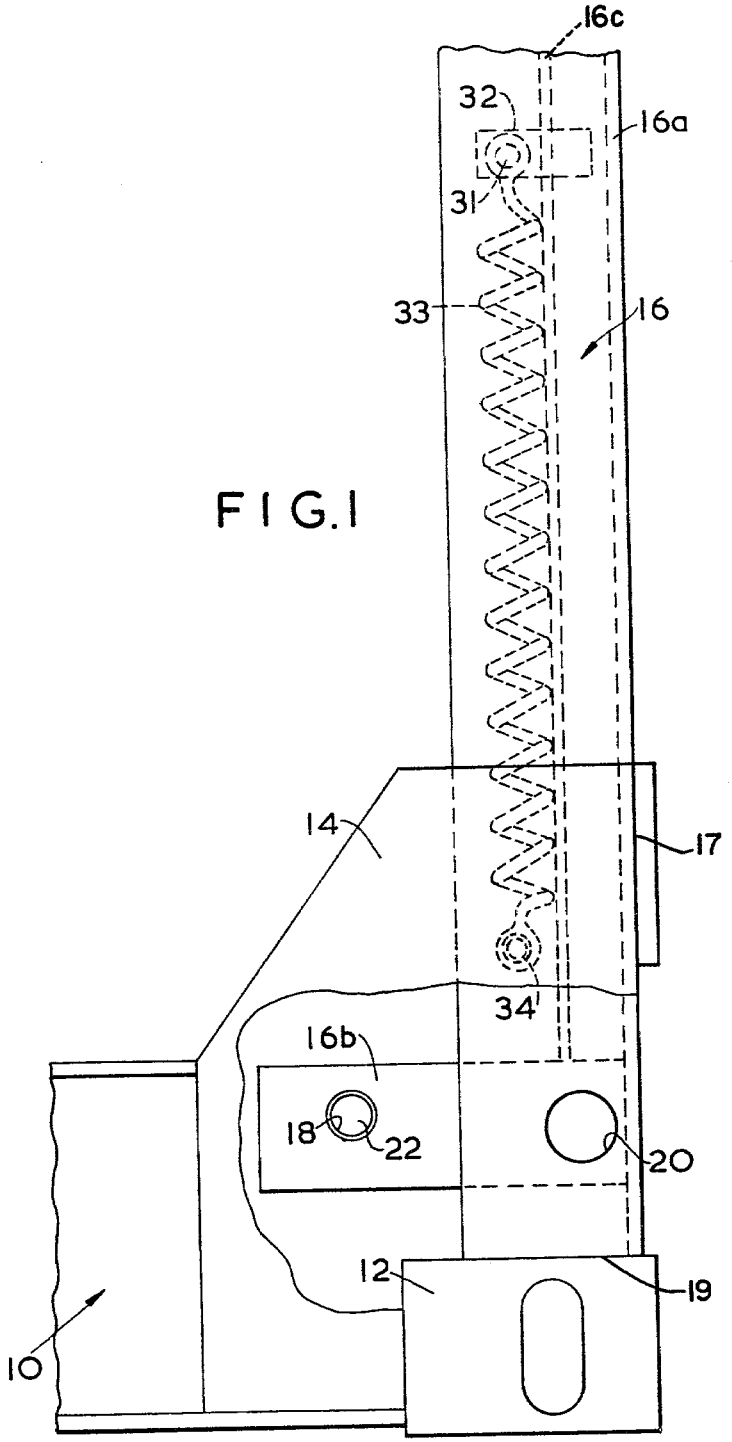
FIG. 1 is a diagrammatic side view of a corner assembly of a freight carrier showing the pivoted end of a corner post when the corner post is in its erected, upright position.

The above drawings mainly show the corner assembly of a freight carrier and for a fuller description of the remainder of the general type of freight carrier involved, reference is directed to our U.S. Pat. No. 3,568,608.

The carrier includes a rectangular base structure comprising a frame made from welded steel channels and rolled steel joists on which a wooden floor is laid to support the goods to be transported. The carrier is usually made in a convenient standard size for carrying on a lorry trailer or other wheeled vehicle.

Referring now to FIGS. 1 to 4 of the drawings, the base structure of the carrier comprises side members 10 of channel section and end members 11 which meet at corner castings 12. Each corner assembly includes a plate member 14 which is welded to the side member 10 and to the end member 11 and which has a respective corner post 16 pivotally mounted thereon. Each corner post 16 includes a main portion 16*a* of L-shaped section and a portion 16*b* of rectangular cross section which is welded within the angle of the main section 16*a* at the pivoted end of the post 16 so as to project transversely thereto. Each corner post 16 also includes a secondary portion 16*c* of L-shaped section which is welded within the main section 16*a* to form a rectangular construction which extends along the length of the corner post 16.

The projecting portion 16*b* includes two bores 18 and 20, the bore 18 receiving a bolt 22 carried by the plate member 14 about which the corner post 16 is pivotable relatively to the base structure of the carrier.

Figure 2:
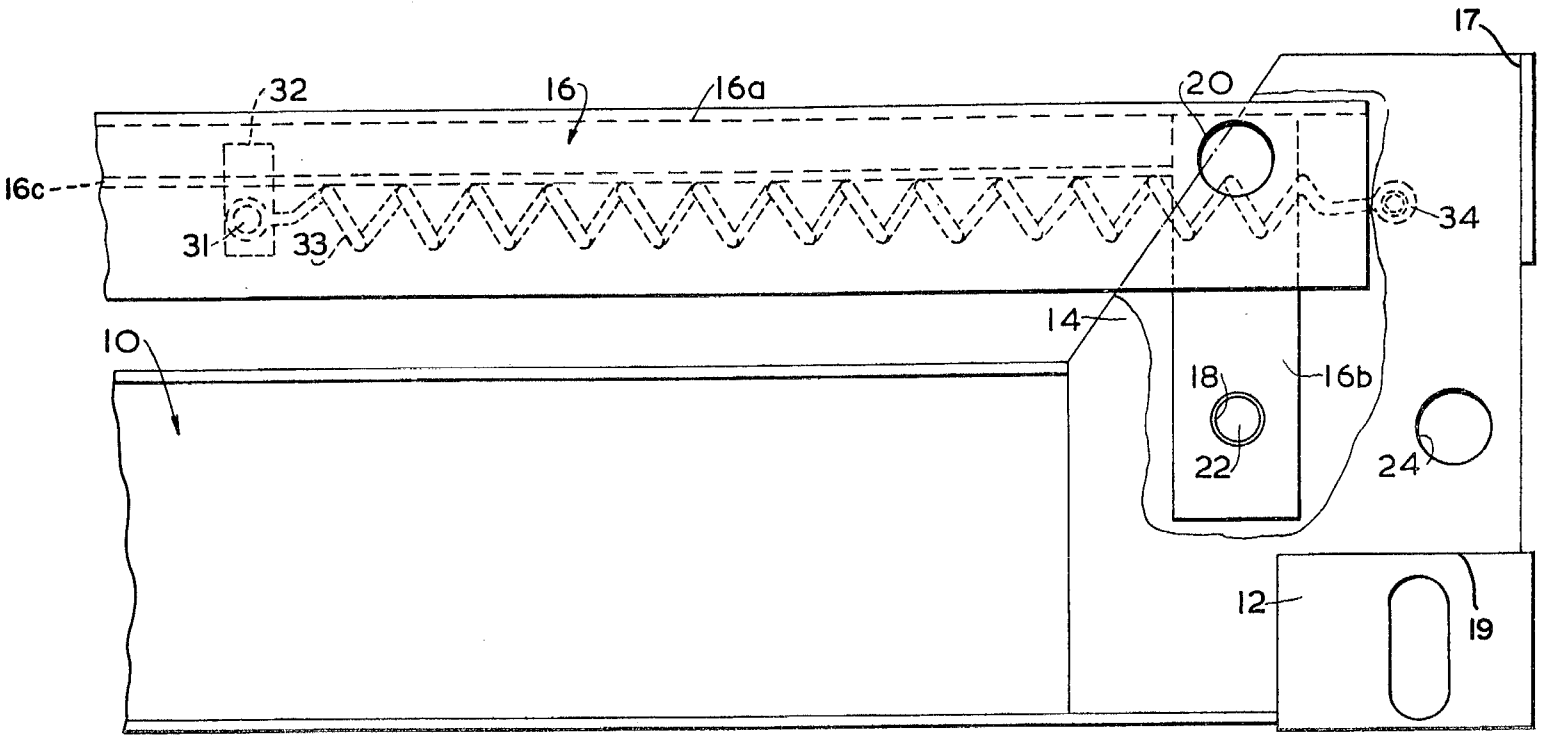
FIG. 2 is a diagrammatic side view of the corner assembly of FIG. 1 showing the pivoted end of the corner post in the folded position.
Figure 3:
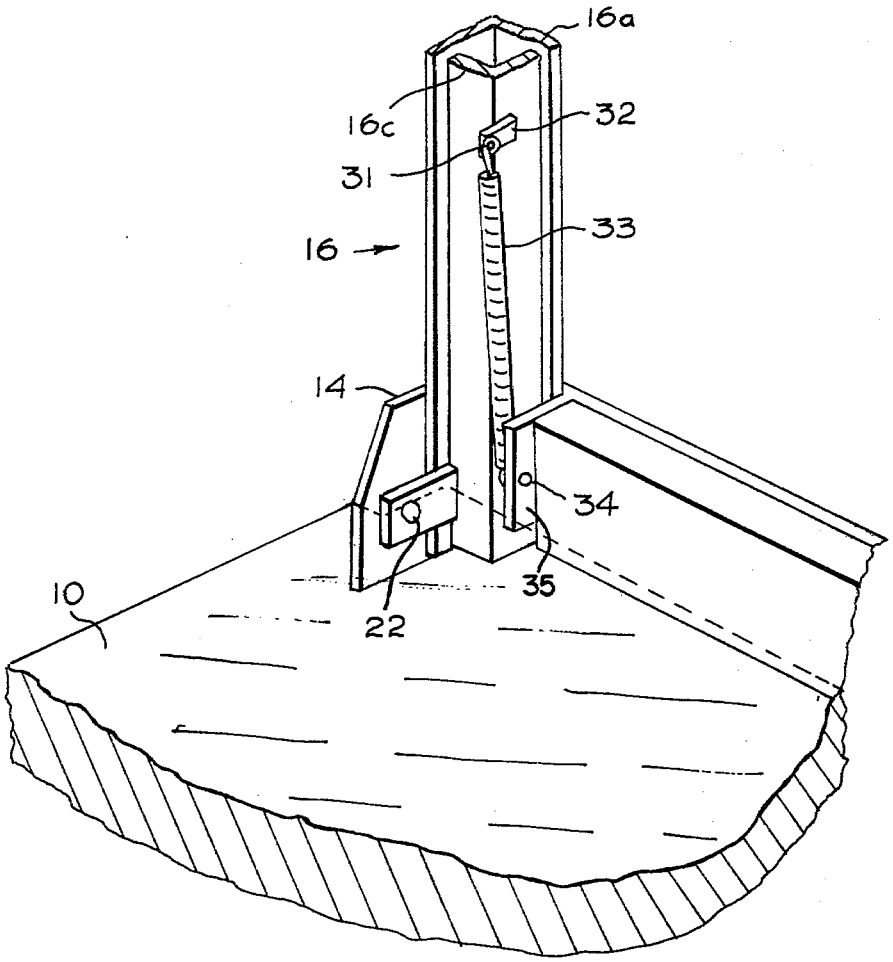
FIG. 3 is a diagrammatic perspective view of one corner of the freight carrier showing the pivoted end of the corner post when the corner post is in its erected, upright position.

Each corner post 16 is arranged to be capable of being pivoted between a folded position, shown in FIG. 2 of the drawings, in which the corner post 16 lies parallel to the side member 10 of the base structure; and an erected position, shown in FIG. 1 of the drawings, in which the corner post 16 is perpendicular to or substantially perpendicular to the side members 10 of the base structure.

The angular displacement of each corner post 16 is limited to the 90° required for the corner post 16 to move between the folded and erected positions by the corner post 16 contacting the base structure of the carrier when the corner post 16 is in the folded position and by the corner post 16 coming into contact with stops when moved to the erected position. Said stops are formed by an end face 17 of the plate member 14 which is engaged by an external surface of each associated corner post 16 when the corner post 16 is in the erect position and by an upper face 19 of the corner casting 12 which is contacted by the end face of the associated corner post 16 when said corner post is in the erected position.

The bore 20 in the projecting portion 16*b* of the corner post 16 is arranged, when the corner post 16 is in the erect upright position, to be aligned with a bore 24 in the plate member 14 so that a slidable latch bolt (not shown) can be slidably inserted through the aligned bores 20 and 24 to secure to corner post 16 in the erected upright position.

A helical coil spring 33 is located within the angle of and extends substantially parallel to each corner post 16. One end of the spring 33 is attached to the corner post 16 by means of an anchor pin 31 which connects the spring 33 to an anchor bracket 32. The other end of the spring 33 is attached to a fixed gusset 35 on the plate member 14 by means of an anchor pin 34. The bracket 32 and the pin 34 are positioned so that when the corner post 16 is pivoted about the bolt 22 from the erected position shown in FIG. 1 of the drawings to the folded position shown in FIG. 2 of the drawings, the spring 33 is automatically extended in length.

The disposition of the anchor pin 34 on the plate 14 to one side of the bolt 22, which forms the pivotal connection between the corner post 16 and the base structure of the carrier, produces the extension in length of the spring 33 when the corner post is pivoted about the bolt 22 from the erected to the folded position. The extended spring 33 thus exerts a tensile force between the anchor bracket 32 on the corner post 16 and the anchor pin 34 on the plate 14, which due to the disposition of the anchor bracket 32 above and to one side of the bolt 22, produces a force on the corner post which acts against the pivotal movement of the corner post 16 from the erected to the folded position and tends to partially counter-balance the force exerted by the mass of the corner post 16 during the pivotal movement thereof to the folded position.

When the corner post 16 is in the folded position, and it is required to erect the corner post 16, the stored energy in the extended spring 33 is available to assist the pivotal movement of the corner post 16 to the erected position and partially counter-balances the force exerted by the mass of the corner post 16 during the erection thereof.

Figure 4:
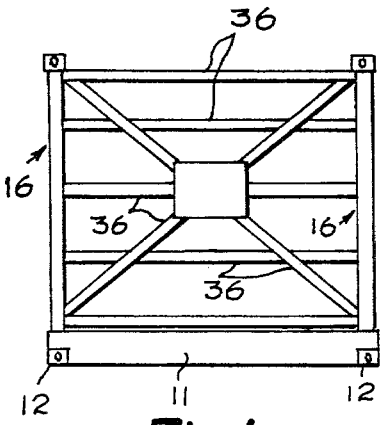
FIG. 4 is a diagrammatic end elevation of the freight carrier showing the corner posts in the erect upright position.

Each corner post 16 can be arranged to pivot as an individual unit or, alternatively, the two corner posts at each end of the carrier can be connected together by cross members 36, shown in FIG. 4 of the drawings to form a unitary end structure. The above described arrangements act to provide a controlled pivoting action for each individual corner post 16, or the end structures in the case when the two corner posts of each end pair are rigidly connected together by the cross members 36, when these are lowered to the folded position; and to partially counter-balance the mass of the corner posts or end structures when these are raised to the erected upright position, hence reducing the manual effort required.

Figure 5:
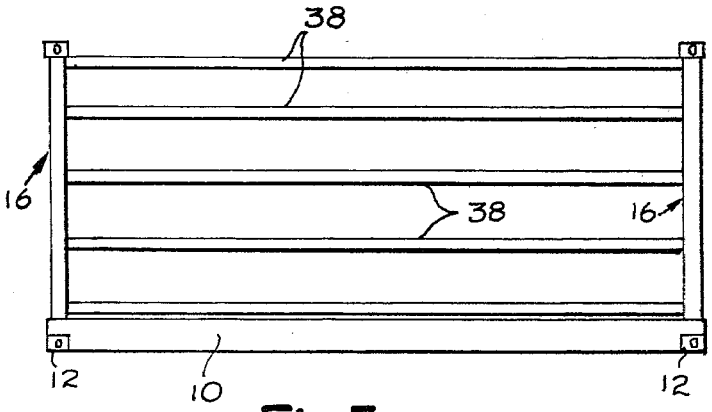
FIG. 5 is a diagrammatic side elevation of a modified freight carrier with the corner posts in the erect upright position.

Referring now to FIG. 5 of the drawings, in a modification each of the corner posts 16 are arranged to be pivotally movable to lie, in the folded position transversely of the base structure of the carrier. The corner posts can here again, be arranged to pivot as individual units or, alternatively, the pair of corner posts 16 at each side of the carrier are connected together by cross members 38 to form unitary side structures. Each of the corner posts 16 is provided with the above described counter-balancing arrangements to allow a controlled pivoting action for the individual corner posts or the side structures, when each post or each side structure is lowered to the folded position, and to partially-balance the mass of each post or each side structure when the post or structure is raised to the erected upright position.

We claim:

1. A freight carrier comprising: a substantially flat rectangular base structure; the two post members associated with each end of the base structure having means for interconnecting the two post members together to form a unitary, substantially plane end structure at each end of the base; means for pivotally directly connecting each end structure to its associate end of the base structure, so that the end structure is pivotally movable from a folded position, in which the end structure lies parallel to the base structure, to an erect, upright position in which the end structure is perpendicular to the base structure; elongate resilient means interconnecting the base structure and the unitary end structure for resiliently biasing the end structure towards said erect, upright position, said elongate resilient means being arranged so that, when the end structure is positioned in said folded position with respect to the base structure, the elongate resilient means is of maximum extended length, said elongate resilient means being confined entirely within a plane defined by one of said associated end structure or the base structure when the end structure is positioned in said folded position, with respect to the base structure, and when the end structure is positioned in said erect, upright position, with respect to the base structure.

2. A freight carrier according to claim 1, wherein each end structure further comprises anchor means adjacent said pivot means, affixed to and located entirely within one of the planes defined by one of said end structure or said base structure, one end of said resilient means being secured to said anchor means, said anchor means being located in said one plane whether said end structure is in said upright position or said folded position.

3. A freight carrier according to claim 2 wherein said pivot means is located within the outer of the planes defined by one of said end structure or said base structure, said anchor means being located in said one plane and said pivot means being located in said other plane whether said end structure is in said upright position or said folded position.

4. A freight carrier according to claim 3, wherein said pivot means is located within a plane defined by said base structure and said anchor means is located within a plane defined by said end structure, whereby said pivot means, anchor means and said resilient biasing means are protected from possible damage by outside forces whether said end structure is in said folded position or in said erect, upright position.

5. A freight carrier according to claims 3 or 4 wherein said resilient biasing means comprise a helical coil spring, said anchor means being located on a side of said pivot means which is remote from the free, outer end of said end structure when said end structure is in said folded position.

6. A freight carrier according to claim 1, 2, 3 or 4, further characterized in that abutment means are provided on said base structure for preventing each end structure from being pivoted past said erect, upright position.

7. A freight carrier comprising: a substantially flat rectangular base structure having a post member at each corner thereof; means for pivotally directly connecting each said post member to the associate corner of the base structure so that said post member is pivotally movable from a folded position, in which the post lies parallel to the base structure to an erect upright position, in which the post is perpendicular to the base structure; and elongate resilient means interconnecting the base and each post for resiliently biasing the posts toward the erect upright position, said elongate resilient means being arranged so that, when the post is positioned in said folded position with respect to the base structure, the elongate resilient means is of maximum extended length, said elongate resilient means being confined within a plane defined by one of said base structure or by a pair of posts at one end of said base structure when said pair of posts are in an erect upright position or a folded position.

8. A freight carrier according to claim 7, wherein each end structure further comprises anchor means adjacent said pivot means, affixed to and located entirely within one of the planes defined by one of said base structure or by a pair of posts at one end of said base structure when said pair of posts are in an erect upright position or a folded position, one end of said resilient means being secured to said anchor means, said anchor means being located in said one plane whether said pair of posts are in said upright position or said folded position.

9. A freight carrier according to claim 8 wherein said pivot means is located within the other of the planes defined by one of said base structure or by a pair of posts at one end of said base structure when said pair of posts are in an erect upright position or a folded position, said anchor means being located in said one plane and said pivot means being located in said one plane and said pivot means being located in said other plane whether said end structure is in said upright position or said folded position.

10. A freight carrier according to claim 9 wherein said pivot means is located within a plane defined by said base structure and said anchor means is located within a plane defined by a pair of posts at one end of said base structure when said pair of posts are in an erect upright position or a folded position, whereby said pivot means, anchor means and said resilient biasing means are protected from possible damage by outside forces whether said end structure is in said folded position or in said erect, upright position.

11. A freight carrier according to claims 9 or 10 wherein said resilient biasing means comprise a helical coil spring, said anchor means being located on a side of said pivot means which is remote from the free, outer end of said end structure when said end structure is in said folded position.

12. A freight carrier according to claims 7, 8, 9 or 10, further characterized in that abutment means are provided on said base structure for preventing each end structure from being pivoted past said erect, upright position.

* * * * *